US007150650B2

(12) United States Patent
Kuo

(10) Patent No.: US 7,150,650 B2
(45) Date of Patent: Dec. 19, 2006

(54) CARD CONNECTOR WITH BOTTOM PLATE

(75) Inventor: Ming Lun Kuo, Tu-Chen (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/115,577

(22) Filed: Apr. 26, 2005

(65) Prior Publication Data

US 2005/0287870 A1 Dec. 29, 2005

(30) Foreign Application Priority Data

Jun. 28, 2004 (TW) ..... 93210088 U

(51) Int. Cl.
*H01R 13/648* (2006.01)

(52) U.S. Cl. ..... 439/607

(58) Field of Classification Search ..... 439/159, 439/607, 892, 64, 377, 630, 357; 361/737
See application file for complete search history.

(56) References Cited

U.S. PATENT DOCUMENTS 5,941,725 A * 8/1999 Brennan et al. ..... 439/357
6,058,018 A * 5/2000 Gerrits et al. ..... 361/737
6,071,149 A * 6/2000 Hara ..... 439/607
6,183,273 B1 * 2/2001 Yu et al. ..... 439/92
6,269,005 B1 * 7/2001 Tung et al. ..... 361/737
6,290,136 B1 * 9/2001 Koseki et al. ..... 235/475
6,736,656 B1 * 5/2004 Yu ..... 439/159
2005/0287855 A1 * 12/2005 Taguchi ..... 439/159

FOREIGN PATENT DOCUMENTS

TW 093209936 * 6/2004

* cited by examiner

*Primary Examiner*—Chandrika Prasad
(74) *Attorney, Agent, or Firm*—Wei Te Chung

(57) ABSTRACT

A card connector comprises an insulating housing; a plurality of contacts retained in the insulating housing; a shielding being approximate encircled fame to defining a card receiving space with a card inserting opening at one end thereof along a card inserting direction and another opening cooperated with the housing at the other end thereof, the shielding having a pair of opposite side edges, one of the side edges being in substantially linear configuration and the other of the side edges being in a step configuration so that width of the card inserting opening is wider than that of the insulating housing.

14 Claims, 6 Drawing Sheets

CARD CONNECTOR WITH BOTTOM PLATE

BACKGROUND OF THE INVENTION

1. Field of the Invention

The present invention is generally related to a card connector, and more particularly, to a card connector having a bottom plate.

2. Description of Related Art

Most notebooks are provided with PC card connectors for accommodating PC cards as storage mediums. For adapting to developments of the communication technology and electronic technology, the industry standard of the PC card need to update ceaselessly. According to the newest industry standard (Expresscard PC Card Standard), express cards which have more quicker speed than conventional PC cards at data transmission are achieved. Thus, express card connectors are also achieved for receiving express cards. The express card has two types in configuration, one is rectangular and another is L-shaped.

A conventional express card connector is approximately L-shaped and can receive a rectangular express card or a L-shaped express card. The card connector comprises an upper shielding disposed on an insulating housing thereof to define a card receiving space. However, one side of the card receiving space faced to a bottom face of the housing is open. When the L-shaped card is inserted into the card connector, because the L-shaped card has an approximate configuration and dimension with the card connector and the card connector is formed with a guiding member to guide the insertion and hold a bottom face of the L-shaped card, thus the L-shaped card can insert into a card receiving space of the card connector to electrically connect with electrical contacts precisely.

However, when the rectangular express card is inserted into the card receiving space of the card connector, because width of card receiving space is wider than that of the rectangular card and no means to hold the card, thus the card can't connect with electrical contacts precisely on occasion but fall out of the card receiving space of the card connector.

Hence, an improved card connector is required to overcome the disadvantages of the related art.

SUMMARY OF THE INVENTION

Accordingly, an object of the present invention is to provided a card connector which has a bottom plate.

To achieve the above objects, a card connector comprises an insulating housing; a plurality of contacts retained in the insulating housing; a shielding being approximate encircled fame to defining a card receiving space with a card inserting opening at one end thereof along a card inserting direction and another opening cooperated with the housing at the other end thereof, the shielding having a pair of opposite side edges, one of the side edges being in substantially linear configuration and the other of the side edges being in a step configuration so that width of the card inserting opening is wider than that of the insulating housing.

Other objects, advantages and novel features of the present invention will be drawn from the following detailed description of a preferred embodiment of the present invention with attached drawings.

DETAILED DESCRIPTION OF THE INVENTION

Reference will now be made in detail to the preferred embodiment of the present invention.

Figure 1:
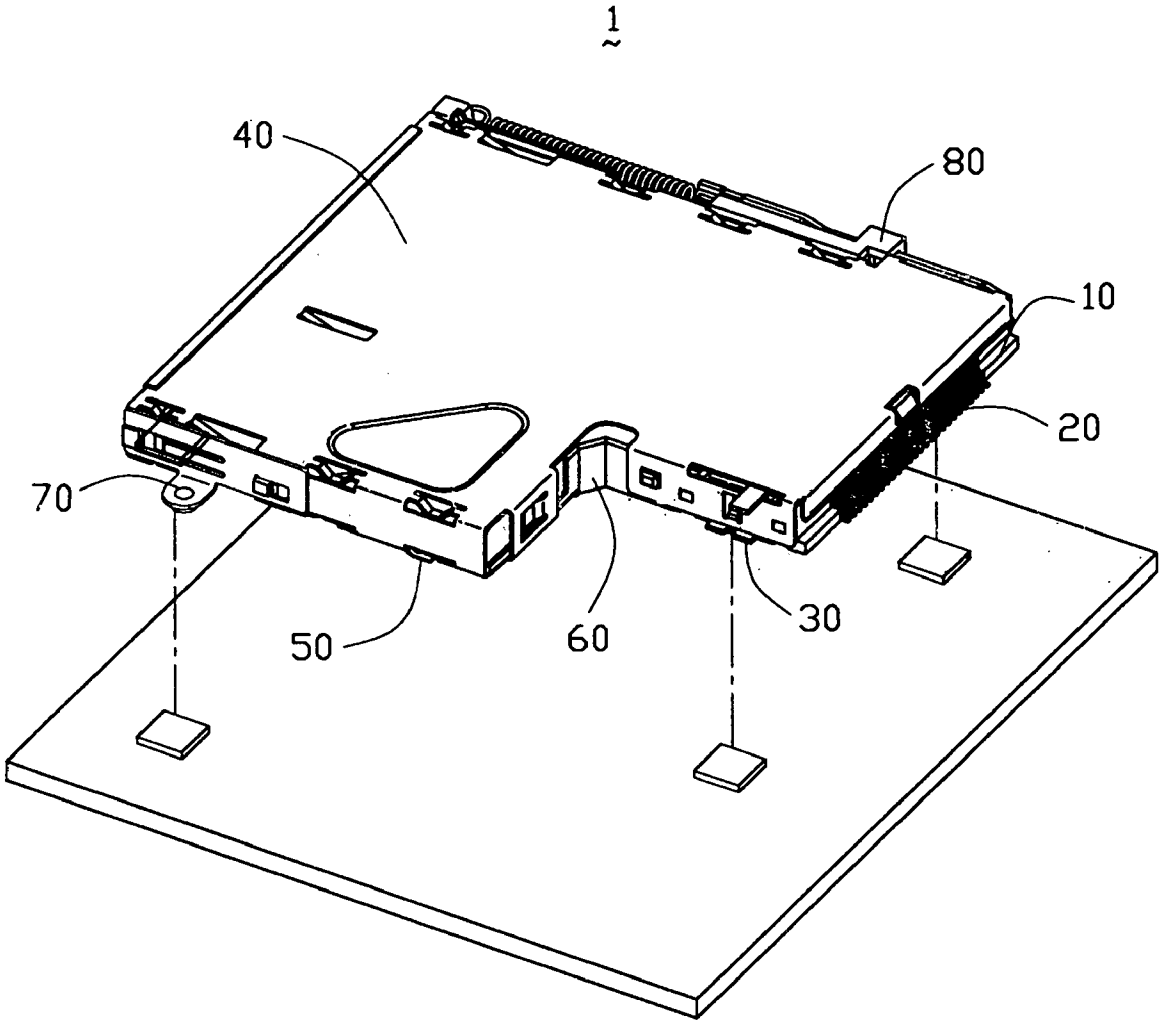
FIG. 1 is a perspective view of a card connector in accordance with the present invention and a printed circuit board to which the electrical card connector is to be mounted.
Figure 2:
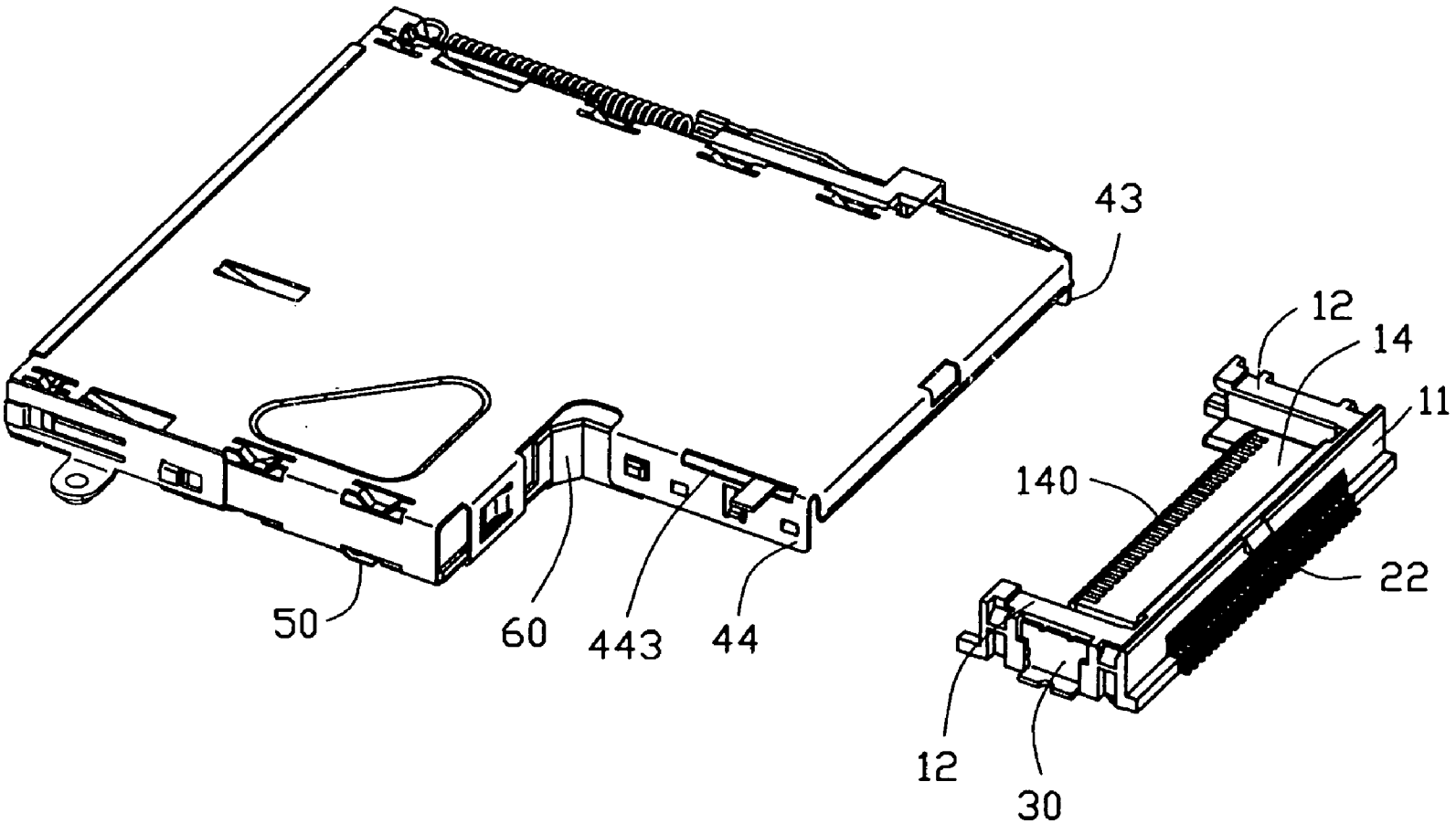
FIG. 2 is a perspective view of the card connector shown in FIG. 1 with a shielding being apart from a housing.

Referring to FIGS. 1 and 2, an electrical card connector 1 in accordance with the present invention comprises an elongated insulating housing 10 having a plurality of connector terminals 20, a pair of soldering pieces 30 received in the insulating housing 10, a shielding 40, a bottom plate 50 disposed under the shielding 40, a guide element 60, a pair of stand off devices 70 and an ejector 80.

Figure 3:
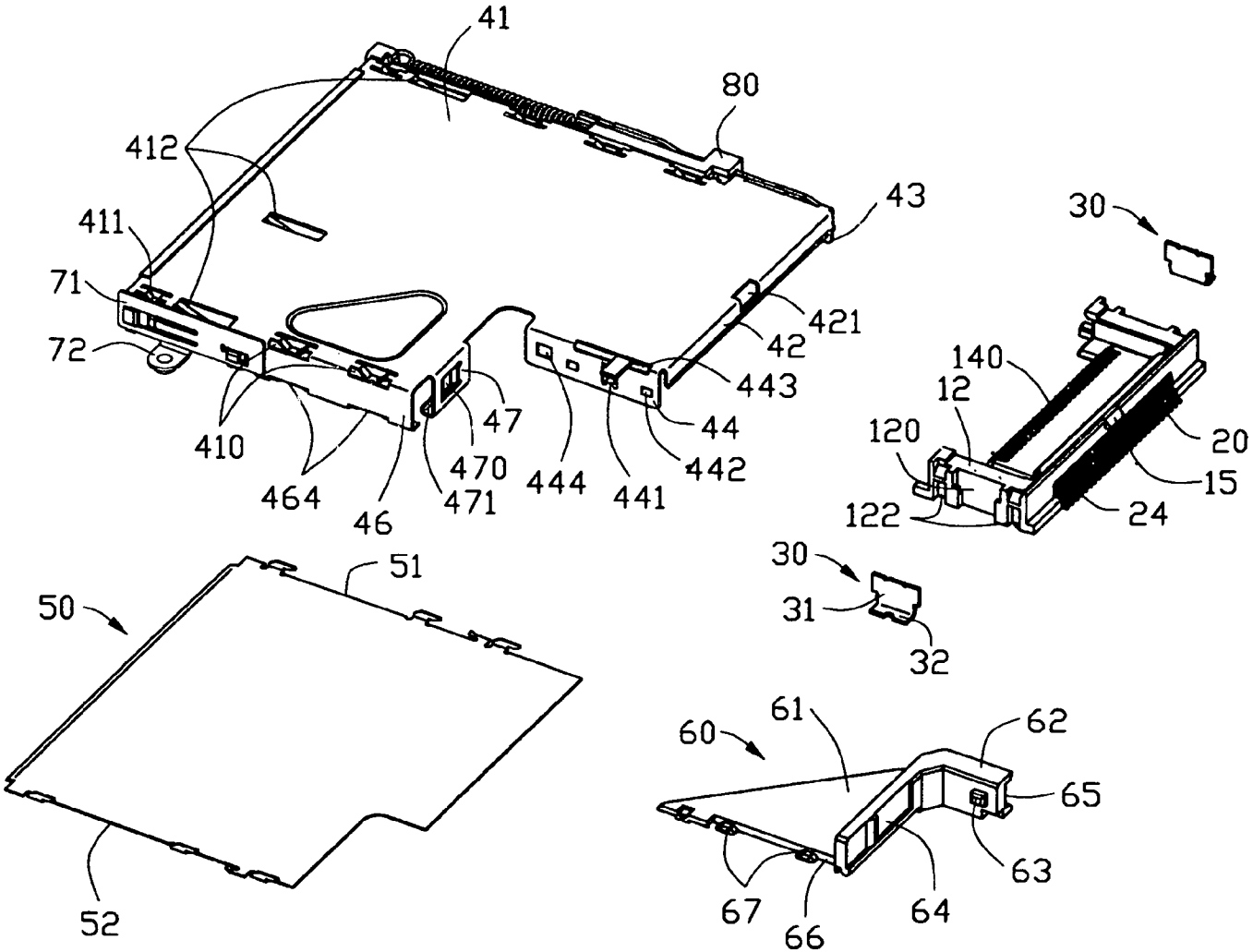
FIG. 3 is an exploded perspective view of the card connector shown in FIG. 1.

Referring to FIGS. 2 and 3, the elongated insulating housing 10 has a base 11, a pair of guiding arms 12 extending backwardly from opposite ends of the base 11 and a mating portion 14 extending from a lower part of the base 11 and disposed between the two guiding arms 12. The base 11 is formed with a block 15 at the front side edge thereof for engaging with the shielding 40. Each guiding arm 12 defines a slot 122 extending downwardly from the upper surface thereof and opening in a side face thereof and a plurality of latch holes 126 besides the slot 122. The mating portion 14 is formed with a plurality of parallel channels 142 for receiving the connector terminals 20. Each connector terminals 20 has a contact portion 22 for electrical connecting with a card, a tail 24 for electrically connecting with a printed circuit board and a fixing portion (not shown) disposed between the contact portion 22 and the tail 24 and fixed in the channels 142 of the insulating housing 10.

The soldering pieces 30 are inserted into the slots 122 of the guiding arm 12, respectively, and each of the soldering pieces 30 has a vertical wall 31 retained in the slot 122 with a plurality of stabs 33 formed on the side edge thereof interferentially engaging with an inner surface of the slot 122 and a leg 32 extending from the vertical wall 31 and protruding out of the insulating housing 10 to fixing on a grounding pad of the printed circuit board. Since the slot 122 opens in the side face of the guiding arm 12, a part of the vertical wall 31 is exposed.

Referring to FIGS. 2 to 5, the shielding 40, served as an upper shielding, is formed and stamped a metallic sheet. The shielding 40 is of an L-shaped configuration from a top view, said L-shaped configuration including a front wider region and a rear narrower region in a front-to-back direction, the insulating housing 1 is located at a rear end of the rear narrower region. The shielding 40 has a main body 41 and a plurality of side edges extending downwardly from edges of the main body 41 to form a card receiving space (48) for accommodating the electrical card cooperating with the main body 41. The card receiving space 48 defines an inserting opening (49) with a width labeled as d. These side edges comprise a front side edge 42 extending from a front edge of the main body 41, a first and a second side edges 43, 44 at opposite sides of the front side edge 42, a third side edge 45 disposed in the same side with the first side edge 43, a fourth side edge 46 disposed in the same side with the second side edge 44 and a longitudinal side edge 47. The first and the second side edges 43, 44 are respectively adjacent to opposite ends of the front side edge 42, the third and the fourth side edges 45,46 are respectively parallel to the first and the second side edges 43, 44. The longitudinal side edge 47 is disposed between the second side edges 44 and the fourth side edge 46.

When the shielding 40 is assembled on the insulating housing 10, the main body 41 covers an upper surface of the insulating housing 10, the front side edge 42 shields the front face of the housing 10 and defines a gap 421 to engage with the block 15 of the housing 10, and the first and the second side edges 43, 44 respectively cover the side face of the guiding arm 12. The first side edge 43 is formed with a plurality of latches 432 extending into corresponding latch holes 122 to fix the shielding 40 to the insulating housing 10. The first side edge 43 defines a cut 433 for the ejecting rod 85 of the ejector 80 passing there through. Further more the first side edge 43 is formed with an elastic piece 431 extending inwardly to electrically abut against the corresponding soldering piece 30 received in the slot 122. The second side edge 44 has a same configuration with the first side edge 43, and has a plurality of latches 442, a cut 443 and an elastic piece 441 abutting against the corresponding soldering piece 30.

Figure 4:
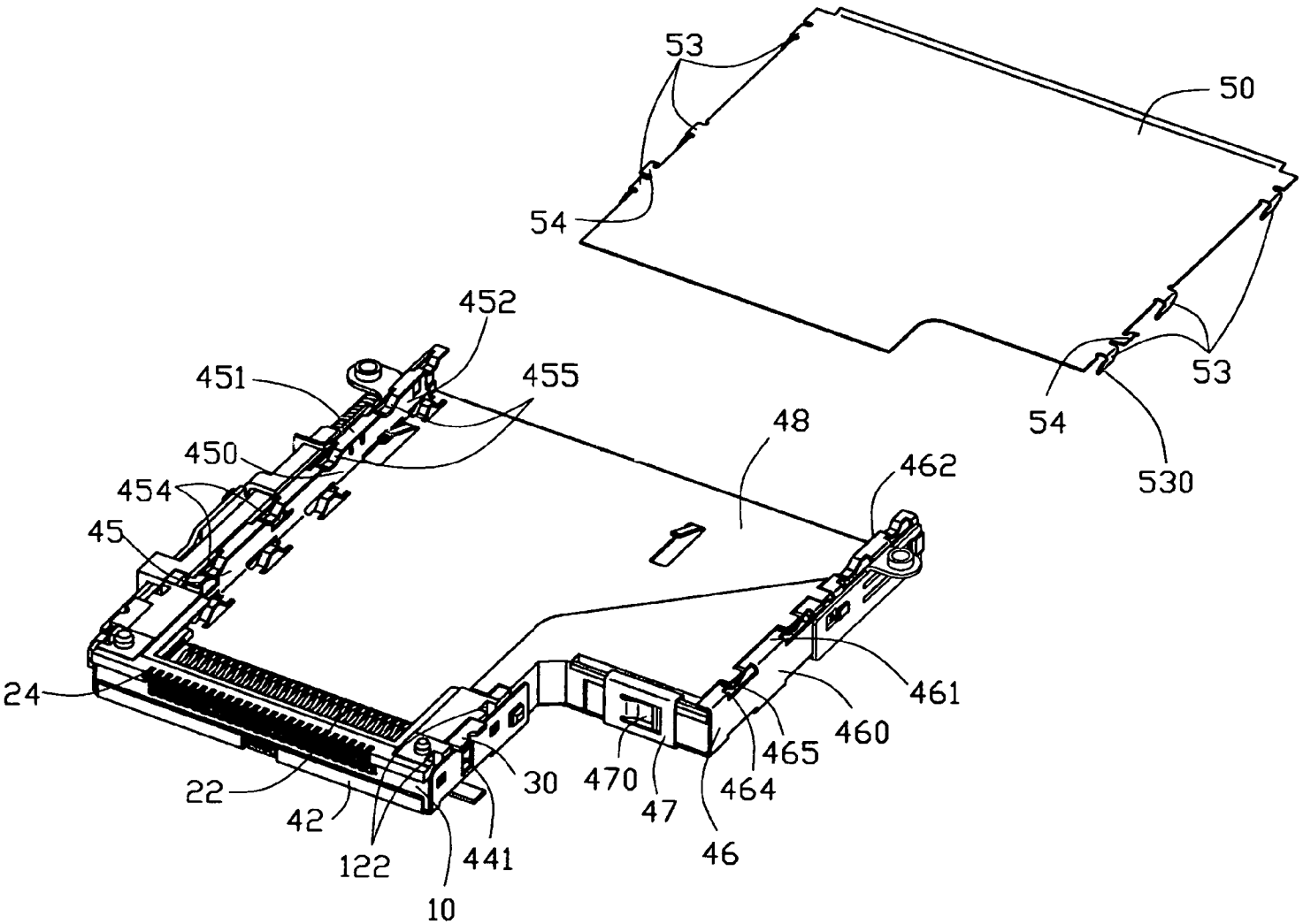
FIG. 4 is a bottom perspective view of the card electrical connector shown in FIG. 1 with a bottom plate not assembled.

Referring to FIGS. 3 and 4, horizontal plates 451,461 extends inwardly from hemlines of the third and the fourth side edge 45, 46, respectively. Guide grooves 452, 462 we defined between the horizontal plates 451,461 and the main body 41 for guiding and holding the insertion/ejection of the card. The horizontal plates 451, 461 are formed with a plurality of extrusive slices 455, 465 along the inserting direction of the card to define a plurality of cuts 454, 464 with the side edges 45, 46. The main body 41 is formed with a plurality of depressed slices 411 above the cuts 454, 464 and the slices 455, 465. The card will not swash in an up and down direction in the card receiving space (48) of the shielding 40 due to being resiliently sandwiched by these oppositely disposed slices 411, 455, 465. The longitudinal side edge 47 is bended backwardly from a hemline thereof to form a receive portion 471 for the guide element 60 with a spring arm 470 extending to the receive portion 471.

Figure 5:
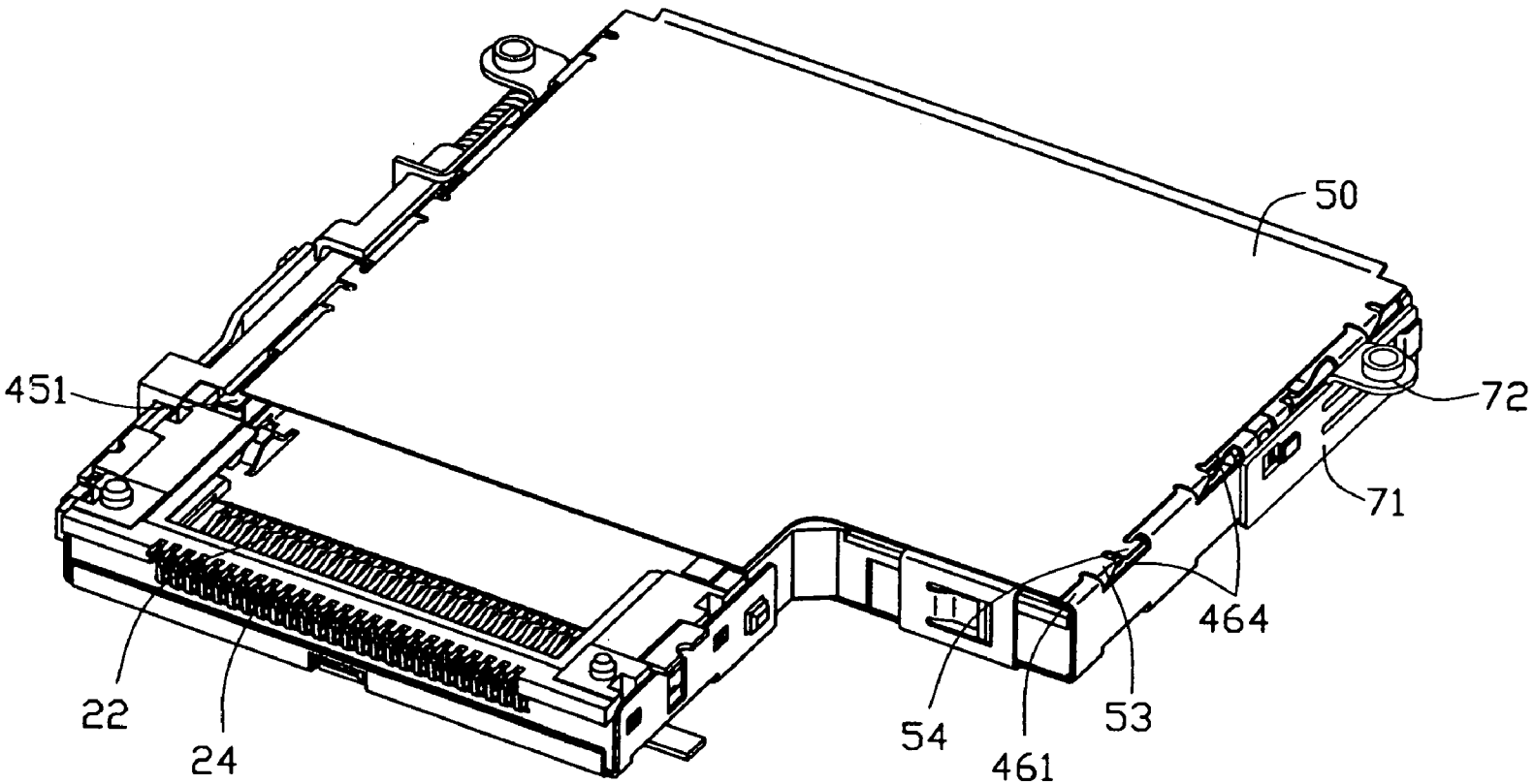
FIG. 5 is a bottom perspective view of the card electrical connector shown in FIG. 1.

Referring to FIGS. 3 to 5, the bottom plate 50, served as a lower shielding, is formed a metal sheet and has a approximate configuration with the shielding 40. The bottom plate 50 includs a main portion (not labeled) being of a rectangular configuration essentially and mainly aligned with the front wider region in a vertical direction, perpendicular to the front-to-back direction, with a vertical distance similar to a thickness of the insulating housing. The bottom plate 50 is formed with a plurality of clasps 53 with locking portions 530 corresponding to the cuts 454, 464 on a pair of side edges thereof along the card inserting direction and a locking arm 54 arranged between the clasps 53 on the same side edge and extending backward. When the bottom plate 50 is assembled on the shielding 40, the clasps 53 are locking in the cuts 454, 464 of the horizontal plates 451, 461 with the locking portion 530 being inserted into. The locking arms 54 are also inserted into the cuts 454, 464 to prevent the bottom plate 50 from moving along the card inserting direction.

Referring to FIGS. 2 to 4, the guider element 60 is approximately in a triangle shape, and has a board 61 and a L-shaped perpendicular side edge 62 extending forwards and downwardly from the front of the board 61. The board 61 is received in the receive portion 471 of the longitudinal side edge 47 and abuts against the fourth side edge 46, the perpendicular side edge 62 abuts against the second side edge 44 of the shielding plate 40. The perpendicular side edge 62 is formed with a projection 63 and a depressed portion 64 on an out surface thereof, the spring arm 470 of the longitudinal side edge 47 is abutting against an inner side edge of the depressed portion 64, and the second side edge 44 of the shielding plate 40 is formed with a fixing hole 444 engaging with the projection 63 of the guider element 50. The perpendicular side edge 62 is defined a guide channel 65 extending from the front portion of the perpendicular side edge 62 for guiding the electrical card inserting into or ejecting out of the electrical card connector 1.

Each of the stand off device 70 has a flake 71 assembling on the shielding 40 and an engaging portion 72 soldered to a grounding pad of the printed board circuit. Further more the stand off device 70 in the same side with the ejector 80 is provided with an extrusive plate 73 extending upwardly (referring to FIG. 6).

Figure 6:
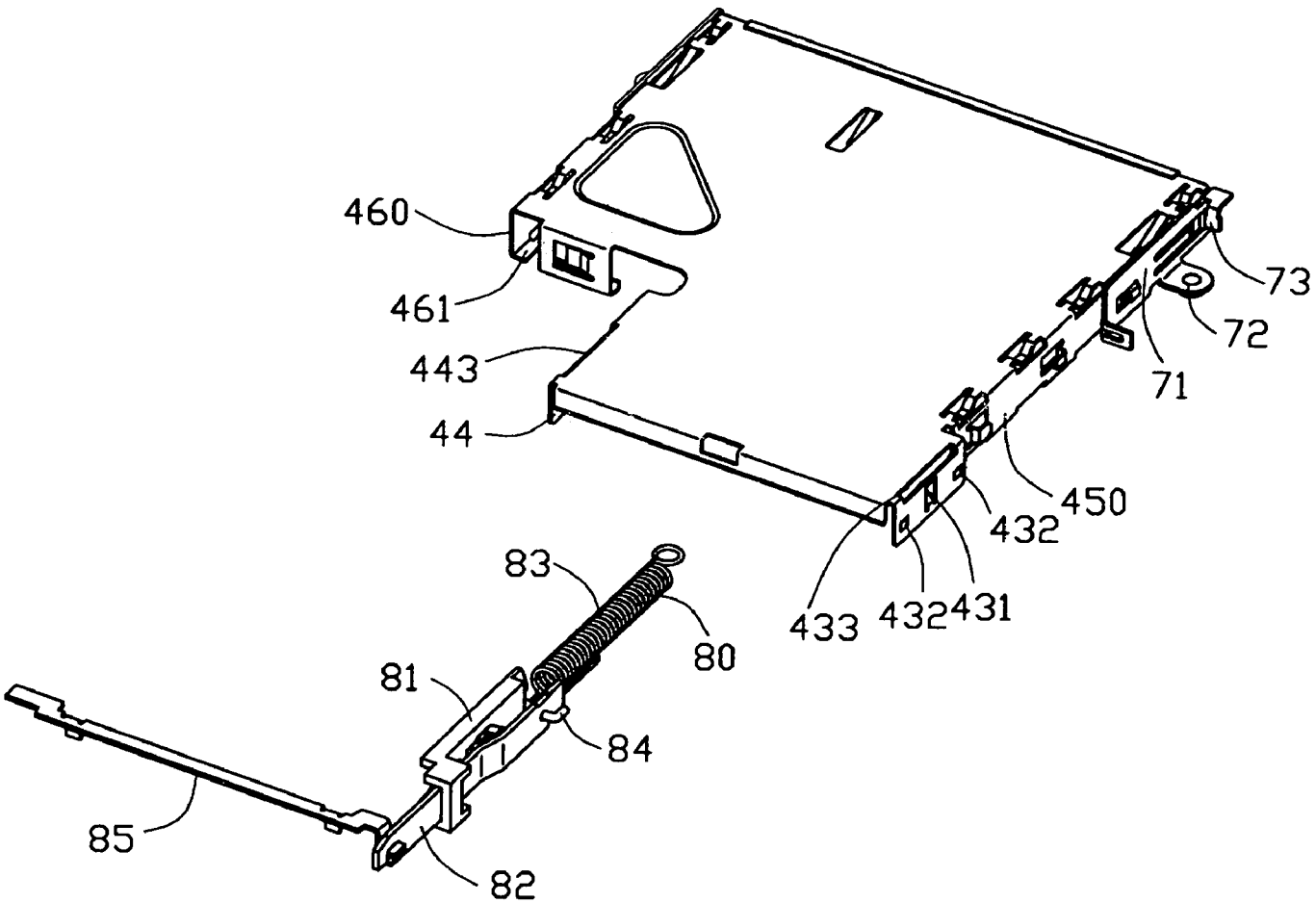
FIG. 6 is a perspective view of the shielding and an ejector of the card connector shown in FIG. 1.

Referring to FIG. 6, the ejector 80 is attached to the third side edge 45 of the shielding plate 40 and comprises a slider 81 having a heart groove, a push rod 82, a spring 83, a link pin 84 and an ejecting rod 85. The push rod 82 is slidely assembled on the slider 81. The spring 83 has a two ends, one end is fasten to the extrusive plate 73 of the stand off 70 assembled on the shielding 40, and the other clasps to the push rod 82 to drive the push rod 82 to slider toward an original position of the push rod 82. The link pin 84 connects with the push rod 82 and may slider in the heart groove of the slider 81. The ejecting rod 85 is sandwiched in between the insulating housing 10 and the shielding 40 by passing through the cuts 433, 443 of the shielding 40 and pivotably connecting with the push rod 82.

The ejector 80 is a push-push type, during inserting the electrical card into the e card connector 1, a front face of the electrical card push the ejecting rod 85 to rotate, so that the push rod 82 is brought to move rearward along with the ejecting rod 85 and the link pin 84 slides in the heart groove. In this state, the spring 83 is deformed until the link pin 84 into a lock position of the heart groove, whereby the electrical card is fully inserted into the electrical card connector 1 and electrical connects with the contactor terminal 20. Pushing the electrical card forward again, the link pin 84 is released from the lock position, then the push rod 82 move forward driven by the resilience force of the spring 83 to bring the ejecting rod 85 to eject the electrical card out of the electrical card connector 1.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector comprising:

an insulating housing;

a plurality of contacts retained in the insulating housing;

a first shielding being of an L-shaped configuration from a top view, said L-shaped configuration including a front wider region and a rear narrower region in a front-to-back direction, said housing being located at a rear end of said rear narrower region; and a second shielding including a main portion being of a rectangular configuration essentially and mainly aligned with the front wider region in a vertical direction, perpendicular to said from-to-back direction, with a vertical distance similar to a thickness of said housing.

2. The card connector as claimed in claim 1, wherein a guiding element is located at a joint corner section of the front wider region and the rear narrower region, said guiding element defining an L-shaped vertical wall section around said corner with a height similar to said vertical distance.

3. The card connector as claimed in claim 2, wherein said guiding element further includes a board closely seated upon the second shielding in a parallel relation.

4. The card connector as claimed in claim 3, wherein the first shielding defines an opening in alignment with the board in said vertical direction.

5. The card connector as claimed in claim 4, wherein both said board and said opening are essentially of a triangular configuration.

6. the card connector as claimed in claim 1, wherein said second shielding further includes an additional portion located in alignment with a front end section of the rear narrow region in said vertical direction.

7. The card connector as claimed in claim 6, wherein a guiding element is located at a joint corner section of the front wider region and the rear narrow region, said guiding element defining an L-shaped vertical wall section with a height similar to said vertical distance.

8. The card connector as claimed in claim 7, wherein a rear segment of the vertical wall is aligned with said additional portion in a lateral direction perpendicular to said both said front-to-back direction and said vertical direction.

9. A card connector comprising:

an insulating housing;

a plurality of contacts retained the insulting housing;

a first shielding being of a first L-shaped configuration from a top view, said first L-shaped configuration including a first front wider region and a first rear narrower region in a front-to-back direction, said housing being located at a rear end of said narrower region; and a second shielding vertically spaced from the first shielding in a parallel relation, and being of a second L-shaped configuration, said second L-shaped configuration including a second L-shaped front wider region and a second rear narrower region; wherein the first front wider region is essentially dimensioned similar to the front wider region in said front-to-back direction while the first rear narrower region is dimensioned longer than the second rear narrower in said front-to-back direction.

10. The card connector as claimed in claim 9, wherein said first wider region and essentially aligned with said second wider region in a vertical direction perpendicular to said front-to-back direction.

11. The card connector as claimed in claim 10, wherein a guiding member is provided around a joint corner between the second wider region and the second narrower region, said guiding member defining an L-shaped vertical wall round said joint corner.

12. The card connector as claimed in claim 11, wherein Said guiding member further includes a board closely seated upon the second shielding in a parallel relationship.

13. The card connector as claimed in claim 9, wherein the second narrower region is aligned with the L-shaped vertical wall in a lateral direction perpendicular to said front-to-back direction

14. The card connector as claimed in claim 13, wherein said first wider region is aligned with said second wider region in a vertical direction perpendicular to both said front-to-back and said lateral direction.

* * * * *